US005553564A

United States Patent [19]

Putney

[11] Patent Number: 5,553,564

[45] Date of Patent: Sep. 10, 1996

[54] AUTOMATIC SEWING MACHINE SYSTEM AND METHOD FOR LOADING AND SEWING WORKPIECES

[75] Inventor: Lawrence B. Putney, Swatara Township, Pa.

[73] Assignee: American Sewing Machine, Inc., Lebanon, Pa.

[21] Appl. No.: 541,875

[22] Filed: Oct. 10, 1995

Related U.S. Application Data

[63] Continuation of Ser. No. 100,277, Aug. 2, 1993, abandoned.

[51] Int. Cl.[6] ..... D05B 21/00; D05B 33/00

[52] U.S. Cl. ..... 112/470.13; 112/470.07; 112/470.16; 112/475.06; 112/475.07; 112/475.09

[58] Field of Search ..... 112/121.14, 121.12, 112/121.11, 262.3, 265.1, 262.2, 121.15, 121.29, 141, 147, 2, 470.06, 470.07, 470.09, 470.12, 470.13, 470.14, 470.16, 475.04, 475.05, 475.06, 475.07, 475.09

[56] References Cited

U.S. PATENT DOCUMENTS

| | | | |
|---|---|---|---|
| 3,428,005 | 2/1969 | Scholl | 112/2 |
| 4,493,276 | 1/1985 | Sadeh | 112/121.12 |
| 4,711,188 | 12/1987 | Yoneda | 112/104 |
| 4,719,863 | 1/1988 | Bisson | 112/121.12 |
| 4,756,261 | 7/1988 | Gershoni | 112/475.07 |
| 4,785,749 | 11/1988 | Fischer | 112/121.12 |
| 4,809,627 | 3/1989 | Upmeier et al. | 112/121.12 |
| 4,813,362 | 3/1989 | Vogt et al. | 112/121.12 |
| 4,819,572 | 4/1989 | Scholl et al. | 112/121.15 |
| 4,821,659 | 4/1989 | Morii et al. | 112/121.15 |
| 4,869,185 | 9/1989 | Scholl et al. | 112/147 |
| 4,909,167 | 3/1990 | Goldbeck et al. | 112/265.1 |
| 4,967,675 | 11/1990 | Goldbeck et al. | 112/262.3 |
| 4,982,676 | 1/1991 | Morii et al. | 112/121.15 |
| 5,000,103 | 3/1991 | Beermann | 112/121.12 |
| 5,058,517 | 10/1991 | Morii et al. | 112/121.15 |
| 5,133,271 | 7/1992 | Iwasaki et al. | 112/114 |
| 5,163,376 | 11/1992 | Frye | 112/470.13 X |
| 5,188,044 | 2/1993 | Brockmann | 112/121.15 |
| 5,255,621 | 10/1993 | Schramayr et al. | 112/121.12 |
| 5,271,344 | 12/1993 | Nishizawa et al. | 112/470.06 X |

*Primary Examiner*—Peter Nerbun
*Attorney, Agent, or Firm*—Dan Williams

[57] ABSTRACT

An automatic sewing machine system for sewing a small workpiece to a larger workpiece by moving the sewing head and needle along an extended predetermined path while the workpieces remain stationary. Also provided is a method for using this system. The larger workpiece is positioned on a rotating work plate before the smaller workpiece is loaded in folding apparatus that folds and positions the smaller workpiece in a predetermined position on the larger workpiece. A clamp mechanism secures the workpieces to the work plate before the work plate is rotated under the sewing head and locked in a stationary position. The sewing head is mounted on a programmable computer controlled extended travel X-Y carriage allowing programmable and automatic control of the seam pattern and the rate at which the sewing head traverses the seam pattern. Stitch density is controlled by adjusting the programmable variable speed reciprocation rate of the sewing head needle in conjunction with the rate at which the sewing head traverses the seam pattern. After the machine is loaded, the system automatically folds and positions the workpieces on the work plate and clamps the workpieces before the work plate is rotated under the sewing head. The work plate is locked in position while a predetermined stitch pattern is applied to sew the workpieces.

18 Claims, 13 Drawing Sheets

AUTOMATIC SEWING MACHINE SYSTEM AND METHOD FOR LOADING AND SEWING WORKPIECES

This application is a continuation of application Ser. No. 08/100,277 filed Aug. 2, 1993, now abandoned.

BACKGROUND

During many sewing operations in the garment industry, it is desirable to quickly load, hold together, and sew together two pieces of fabric material. Sometimes it is also desirable to fold one of the fabric work pieces during loading or at some other time before the work pieces are sewn together.

Some automatic sewing machines are restricted to sewing a linear seam. Other automatic sewing machines have complicated clamping mechanisms moving on X-Y tables. Some machines move the work pieces in an X-Y pattern while the stationary sewing heads sew rectilinear seams. Yet other machines have a sewing head traverse one axis while the holding apparatus moves the workpieces on one or two axis.

Existing pocket setting automatic sewing machines slide positioned fabric work pieces over a fixed table having a polished surface. Work pieces are pressed against the polished surface by work piece holders. The work piece holders cause the work pieces to move into the sewing station from the loading and folding locations. Movement of the work piece holders during the sewing operation creates the seam outline. However, the sliding action of the work pieces over the polished table surface sometimes cause the work piece materials to bunch.

The fastest machine cycle times are achieved by dedicated automatic pocket setting sewing machines, limited to a specific task. These machines have two workpiece holders, each of which is mounted on a cumbersome and expensive guiding system. Only by having two workpiece holders can the machine operator load subsequent workpieces while a previously loaded workpiece is being sewn.

Moreover, when sewing pockets on polo type shirts, current machines require the shirts to be open at the shoulders for the sewing operation to be accomplished. In the garment industry, some types of shirts are sold with and without pockets. In order to minimize warehousing and inventory costs, it is desirable to warehouse these types of shirts without a pocket. After an order is received, pockets could be quickly sewn on the pocketless shirts if the order required. Moreover, pocket placement could be more accurate because it would be the last operation. However, no known machine sews pockets on already finished shirts.

Many small factories in the garment industry do not have skilled repairmen on staff, making it important that sewing machines be simple and require minimum maintenance. Additionally these small factories lack the capital to invest in high cost single purpose dedicated machines and prefer more flexible machines that can be utilized for other purposes.

With the foregoing in mind, it is the object of this invention to produce an automatic pocket setting sewing machine in which the loading and folding operations can be accomplished during the sewing operation thus allowing for minimum machine cycle times.

Yet another object of the present invention is to eliminate workpiece holders and their complicated guiding mechanisms and yet provide fast machine cycle time by giving the operator a location at which to load the next garment while the previously loaded garment is being sewn.

It is another object of the present invention to provide apparatus such that pockets may be positioned, folded, and sewn on already finished garments.

It is an additional object of the present invention that the apparatus be a designed with a minimum of moving parts to effect a simple reliable low cost easily maintained apparatus suitable in use in a factory environment where trained technicians are not available.

It is yet another object of the present invention to provide a pocket setting machine in which the set up may be easily changed to accommodate changing workpieces and sewing seam patterns.

Another object of the present invention is to minimize bunching of workpiece materials caused by sliding workpieces over a polished table when they are being pressed together by a workpiece holder.

Other objects of this invention will become apparent from the following summary of the invention and description of the preferred embodiment of the invention.

SUMMARY OF THE INVENTION

The present invention satisfies the need for a simple low cost system that can be used as an automatic pocket setting machine or that can be modified to accomplish other sewing tasks. This automatic sewing machine system is an automatic sewing machine that manipulates a smaller fabric workpiece to a predetermined position on a second fabric workpiece and then sews the two fabric workpieces together. More particularly, this is an automatic pocket setting sewing machine system that folds, places, and sews pockets on an already finished shirt by holding the workpieces stationary while moving the sewing head and needle in a predetermined path. A method is also provided for using this automatic sewing machine system.

The machine can be modified so that it may sew a pocket to other types of garments. Further modifications and adaptions of the machine allow this automatic sewing machine system to accept, fold or otherwise manipulate a second workpiece into a predetermined position on an already loaded and positioned first workpiece. When modified in this manner, the machine system is capable of performing sewing operations on other garment pieces such as sleeves, cuffs, and collars.

The cost of the automatic system is kept low by having the single loading station coupled to the single sewing station by means of a simple inexpensive rotary transfer system. Mounted on the transfer system are a plurality of work plates. The work plates are rotatably supported by the base. As a first workplate is at the loading station being loaded, a second work plate, having been already loaded with workpieces, is at the sewing station and sewing is being accomplished on those workpieces. Clamping means may be used to clamp positioned workpieces to the work plate before the work plates are rotated, during work plate rotation, and during sewing. Locking means are used to lock work plates in position at the sewing station and at the loading station.

The machine system accomplishes sewing by holding the workpieces immobile while the sewing head traverses an extended programmable predetermined sewing pattern. The sewing head is mounted on an X-Y carriage capable of being driven and positioned by programmable computer control. Control over the reciprocation rate of the needle is also provided. Proper program selection determines the seam outline, the rate at which the seam is sewn, and the stitch density and pattern of the seam.

This automatic sewing machine sews a first workpiece to a second workpiece. The machine has a base from which a loading station and a sewing station are positionally defined. A plurality of work plates are moved between the loading station and the sewing station by transport means supported by the base. A plurality of work plates having a work surface are provided, each work plate being moveable by transport means between a first stationary position at the loading station and a second stationary position at the sewing station. At the sewing station, the base supports an extended travel X-Y carriage which has a moveable and positionable travelling surface. The travelling surface is parallel to the work surface of the work plate at the second stationary position at the sewing station.

Optionally, a loading and folding head provides folding means at the loading station. The head is fixed to the base and has an independently controlled center slider and an outer frame. A second workpiece, when positioned on the slider, is engaged by the outer frame. After engagement, folder blades fold the workpiece edges around the slider. After folding, the folded workpiece is positioned on the first workpiece already on the work table. Using this system, the first workpiece and the second workpiece are positioned for further sewing at one location, the loading station, and then transported in their proximate position to the sewing station.

The sewing head is fixed to the moveable and positionable travelling surface of the extended travel X-Y carriage so that the sewing head is moveable in parallel with the positionable travelling surface of the X-Y carriage. The extended X-Y carriage is a simple ball bushing arrangement with each axis being driven by a lead screw powered by a D. C. brushless servomotor. The maximum travel limits of the sewing head are constrained only by the X-Y carriage size which may be as large as a sheet. Travel limits are increased or decreased by suitable changes to the X-Y carriage size and corresponding changes to the length of the lead screws. The X-Y carriage is moved in varying directions at varying speeds by suitable speed and position control over the driving motors. This allows stitch patterns and seam direction to be varied by controlling and programming the X-Y carriage drive means.

Additionally, the machine has an elongated sewing machine needle which reciprocates on its elongated axis, a Z axis that is perpendicular to the plane of the positionable travelling surface, and is driven by a separate variable speed motor which may be a D. C. brushless servomotor. Controlling all motor speeds and position from a central programmable controller causes the needle reciprocation rate to be variable and controllable along with the position and traverse rate of the sewing head. The result is that seams of different outline, shape, stitch pattern, and stitch density may be sewn by altering the underlying computer program.

The front operating or needle end of the upper sewing head is capable of additional movement in the vertical or Z axis. This additional movement is accomplished by pivotally mounting the rear of the sewing head. Rotational movement of the sewing head around the pivot results in the front operating or needle end of the sewing machine describing a large arc, predominantly in the Z axis. The rotational movement is provided and controlled by a pneumatic cylinder.

A stacker is provided to automatically remove the sewn articles from the work plate. The stacker arm is pivotally attached to the base so that the stacker arm moves between a first lower position and a second upper position. Pneumatically actuated stacker fingers have a pinched position and an open position. When the stacker arm rises, the fingers pinch the sewn garment. As the stacker arm lowers, the sewn articles are pulled from the work plate.

The method for sewing a first workpiece to a second workpiece begins by first positioning a first workpiece on a work plate located at the loading station. A second workpiece is then placed over the first workpiece on the work plate. It is within the scope of this invention to optionally place the second workpiece by loading the second workpiece on a slider, folding the edges of the second workpiece around the slider, moving the folded second workpiece and slider to a position on and contacting the already positioned first workpiece resting on the stationary work plate, and finally removing the slider from between the folded second workpiece and the first workpiece. The positioned workpieces and work plate are rotated to the sewing station and held in a stationary position in the sewing station while sewing is being accomplished. The first and second workpieces are sewn together by moving the sewing head with respect to the stationary work plate and workpieces. After sewing is completed, the workpieces are removed from the sewing plate.

BRIEF DESCRIPTION OF THE DRAWINGS

These and other features, aspects, and advantages of the present invention will become better understood with regard to the following description, appended claims, and accompanying drawings where:

Figure 11:
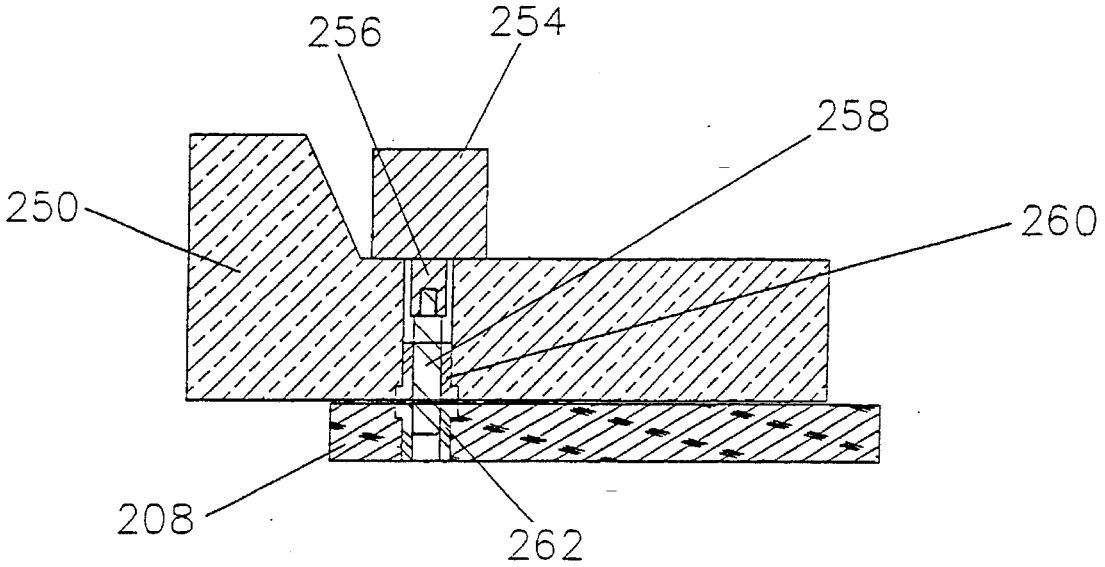
Figure 9:
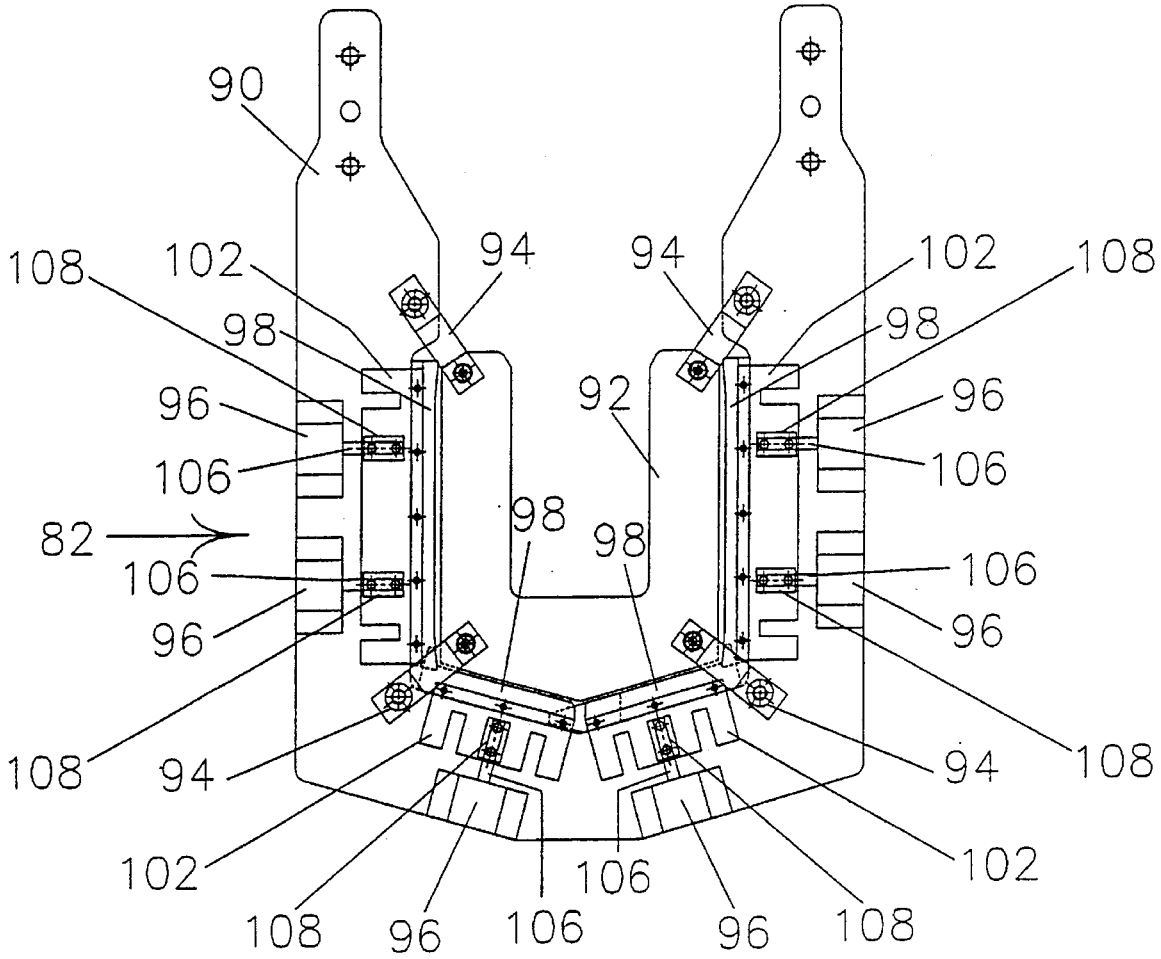
Figure 12B:
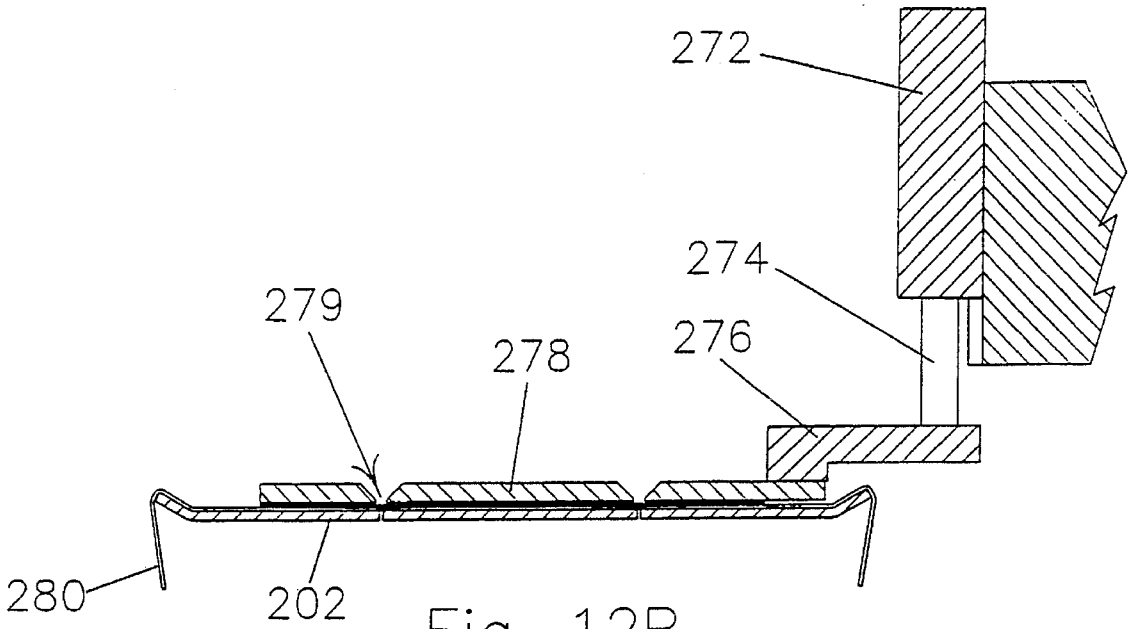
Figure 12A:
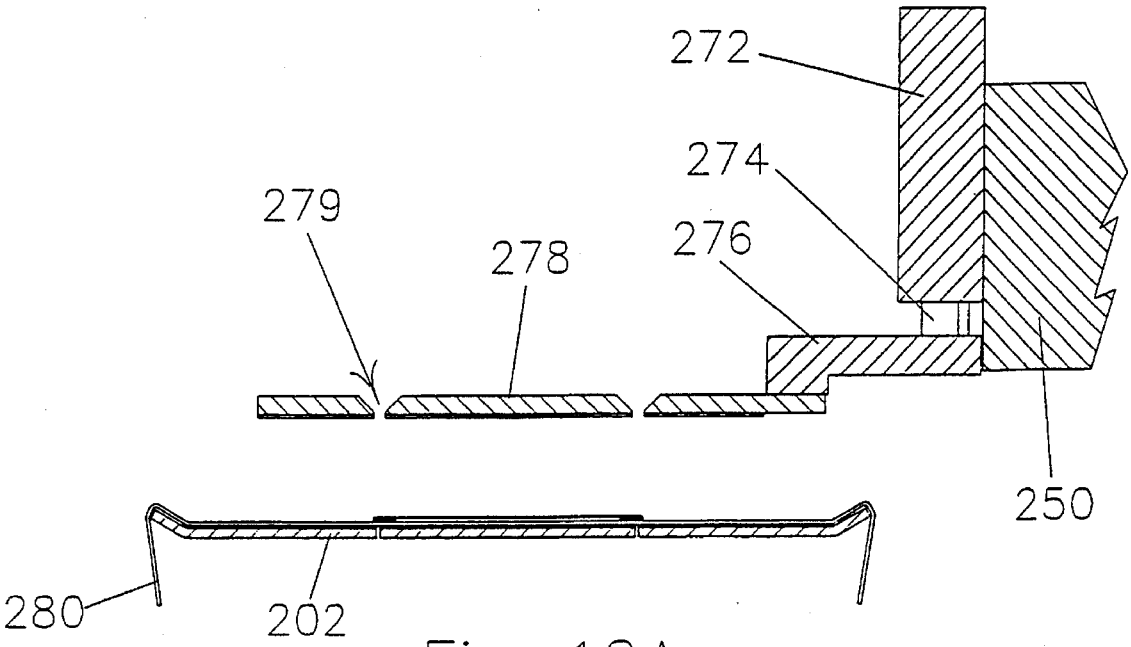
Figure 13:
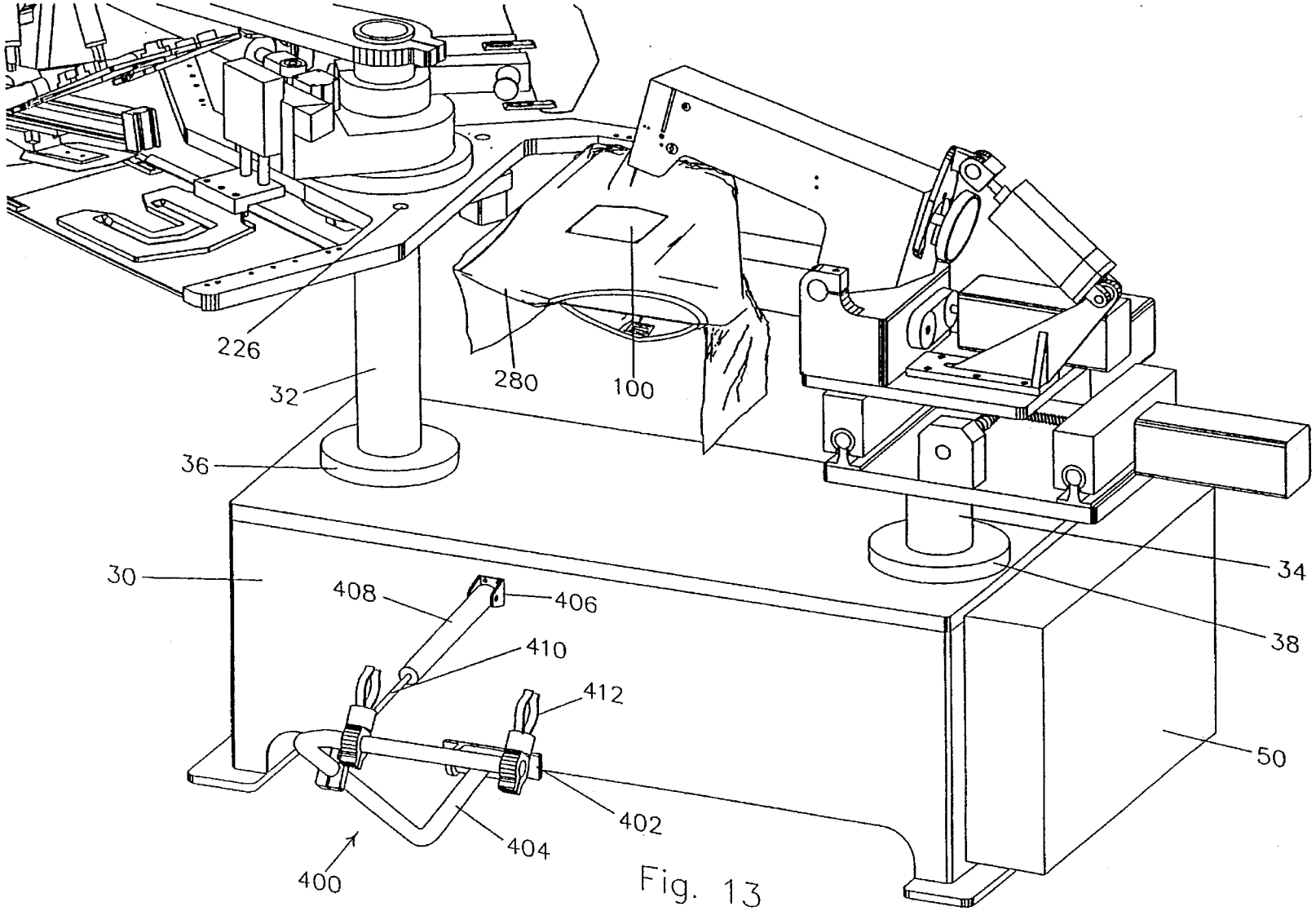
Figure 14:
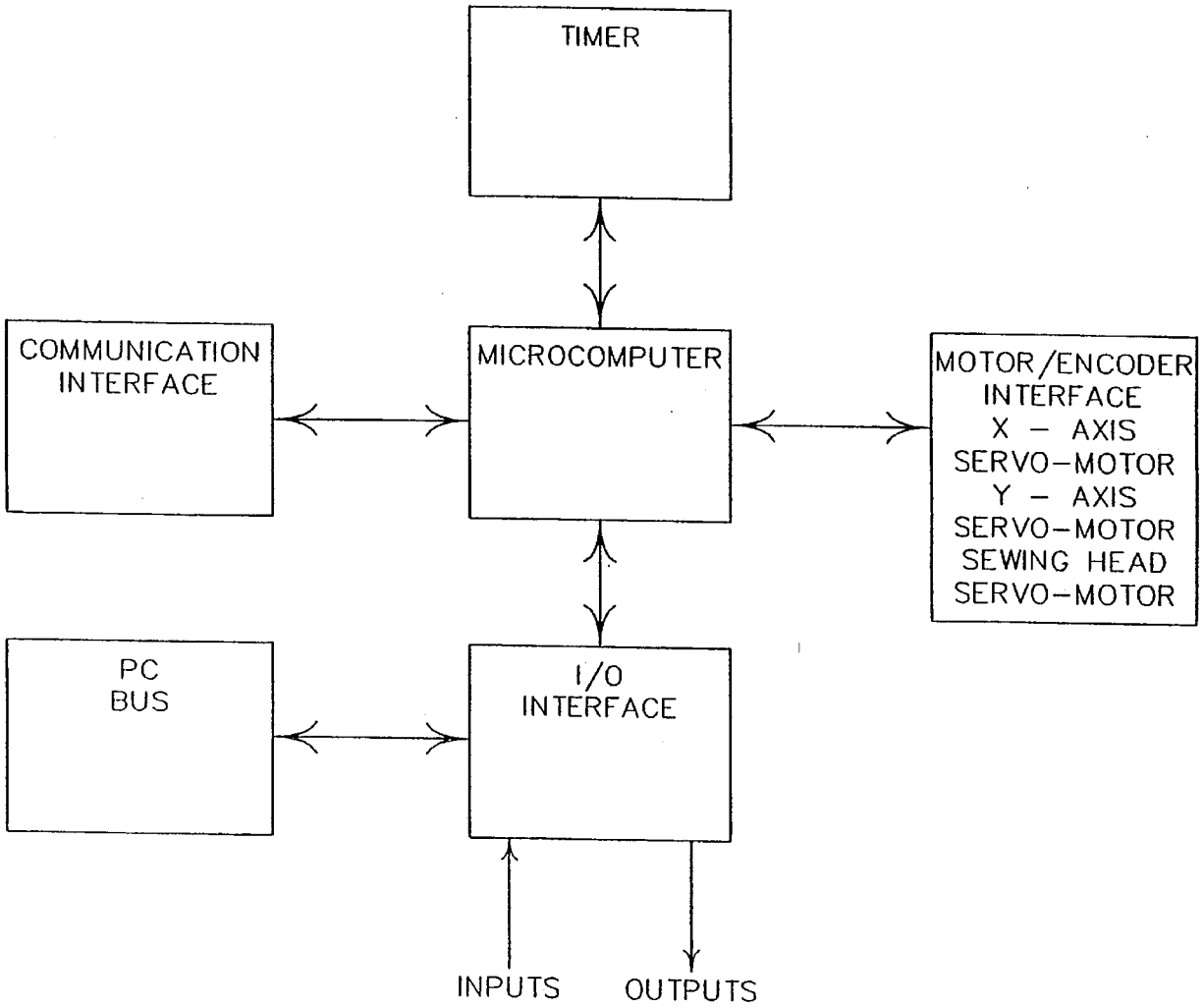

FIG. **8*a*** is a side elevational view of the slider assembly; the slider being in its first retracted position and the slider assembly being in its first upper position;

FIG. **8*b*** is a side elevational view of the slider assembly; the slider being in its second extended position and the slider assembly being in its third lowered position;

FIG. 9 is a top plan view of the outer frame folding assembly; the folding blades being in their second retracted position;

FIG. **10*a*** is an enlarged fragmentary cross sectional view showing the component parts of the folding plate assembly;

FIG. **10*b*** is a cross section of the folding plate assembly with a workpiece between the slider and inner plate;

FIG. **10*c*** is a cross section of the folding plate assembly with a folded workpiece resting on the work plate;

FIG. 11 is a vertical cross sectional view of the clamp plate pivot block with the upper locking alignment pin inserted into upper turntable disc locking bushing;

FIG. 12*a* is a vertical cross section of the clamp and its supporting members, the clamp being in its first raised position;

FIG. 12*b* is a vertical cross section of the clamp and its supporting members, the clamp being in its second clamping position;

FIG. 13 is a simplified fragmentary perspective view the stacker assembly; and FIG. 14 is a block representation of the major functional electronic components of the control unit.

DESCRIPTION

General

Figure 1:
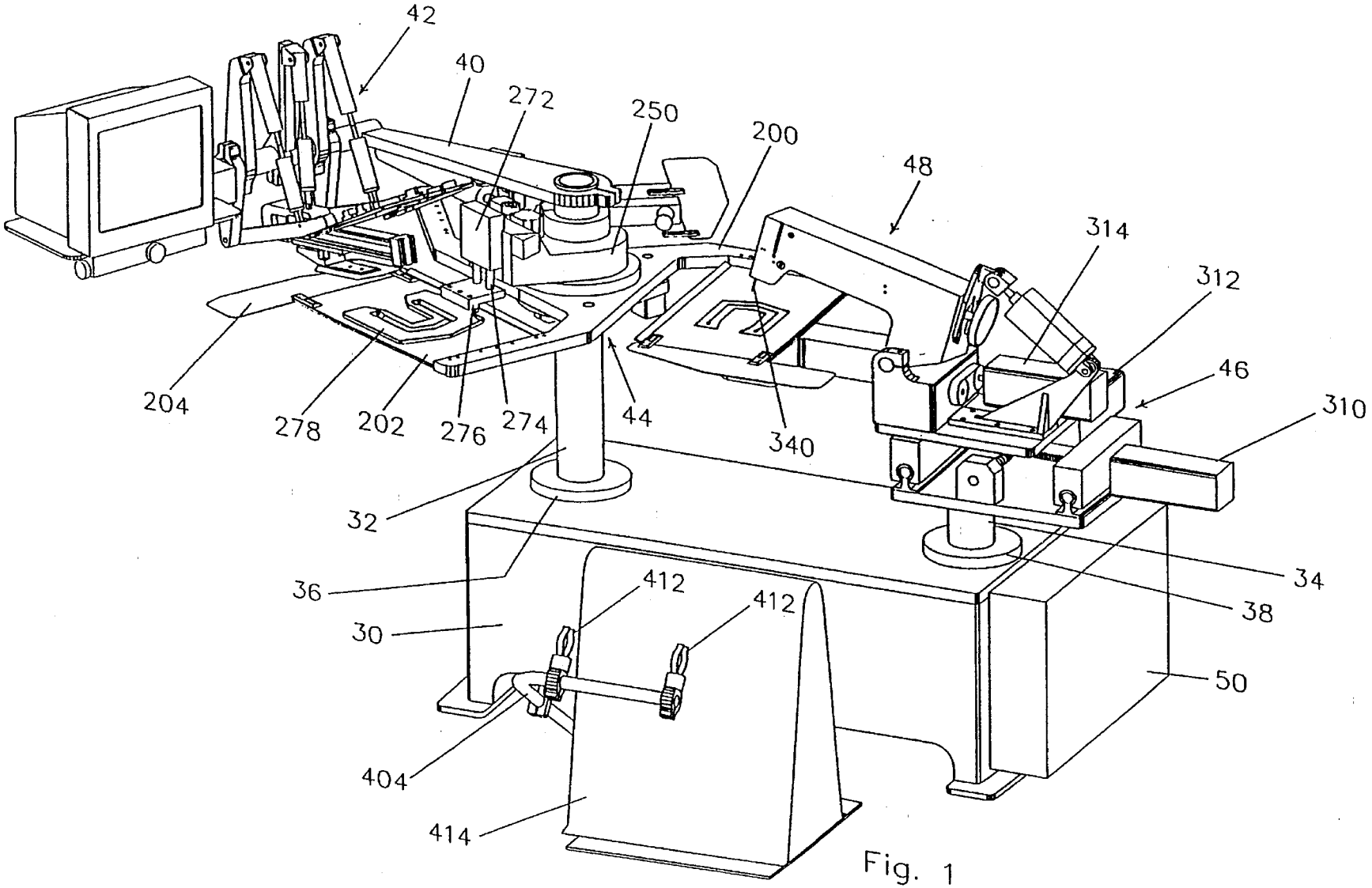
FIG. 1 is a simplified perspective view of an automatic sewing machine embodying features of the present invention.
Figure 2:
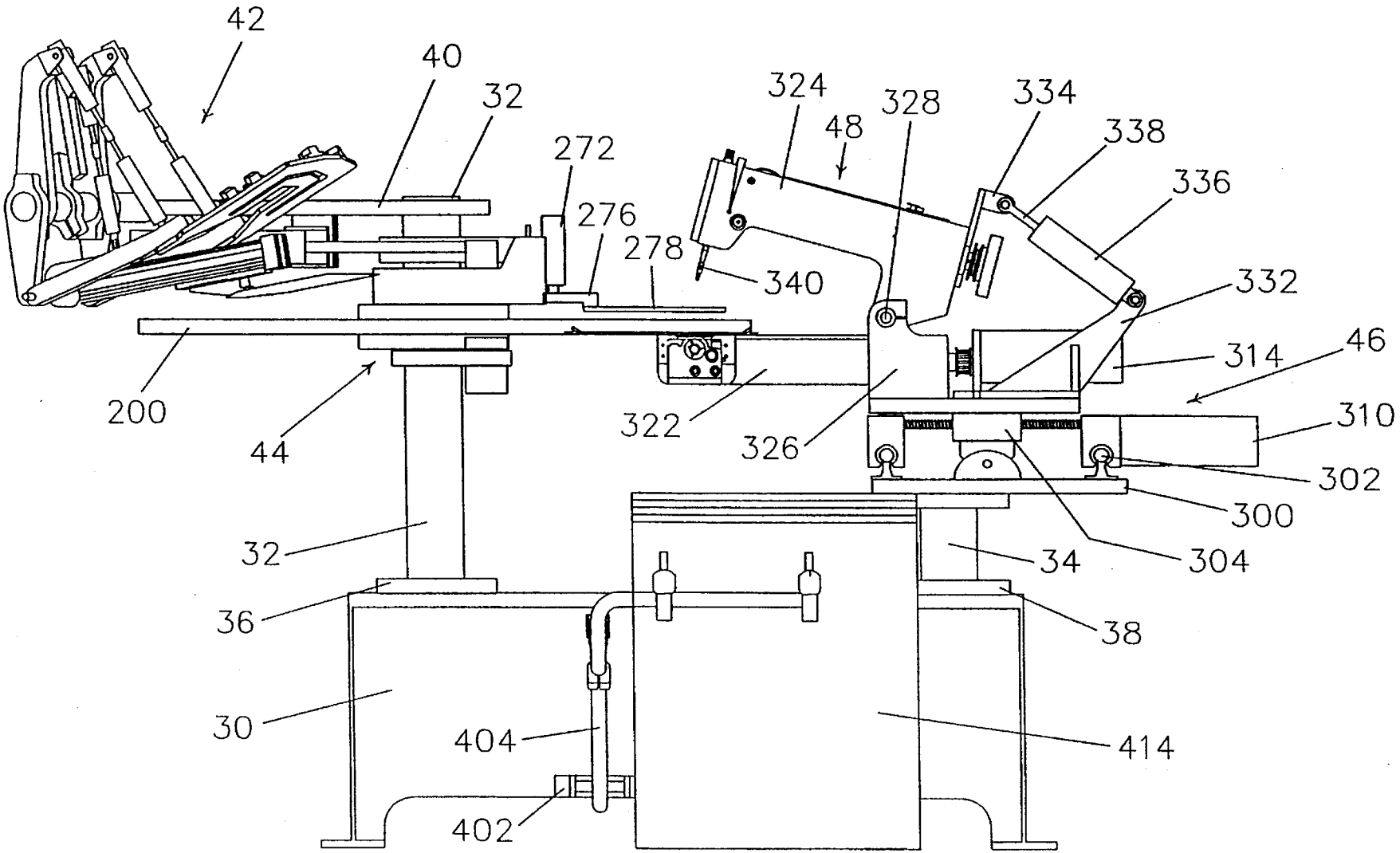
FIG. 2 is a front elevational view of the machine of FIG. 1.
Figure 3:
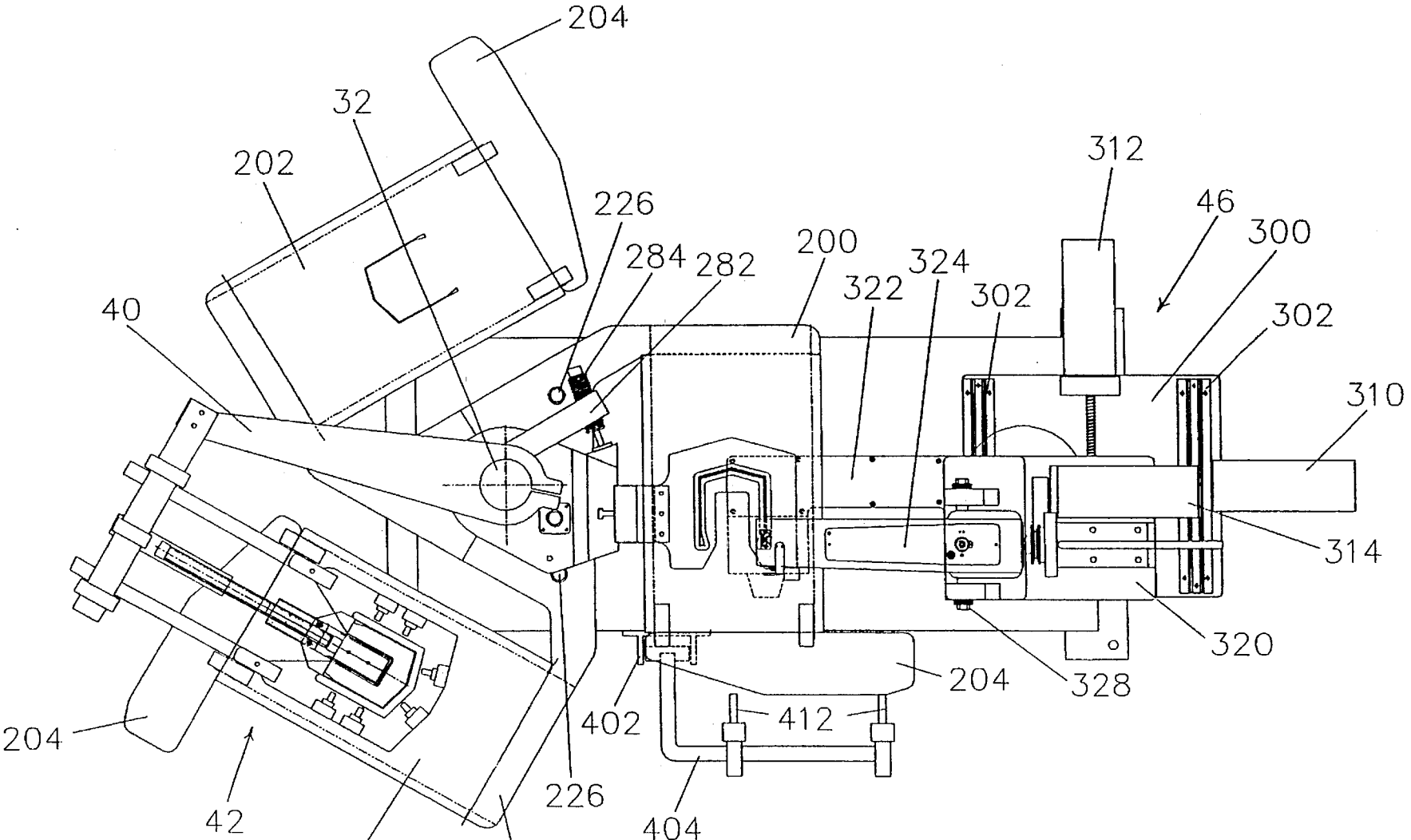
FIG. 3 is a top plan view of the machine of FIG. 1.
Figure 4:
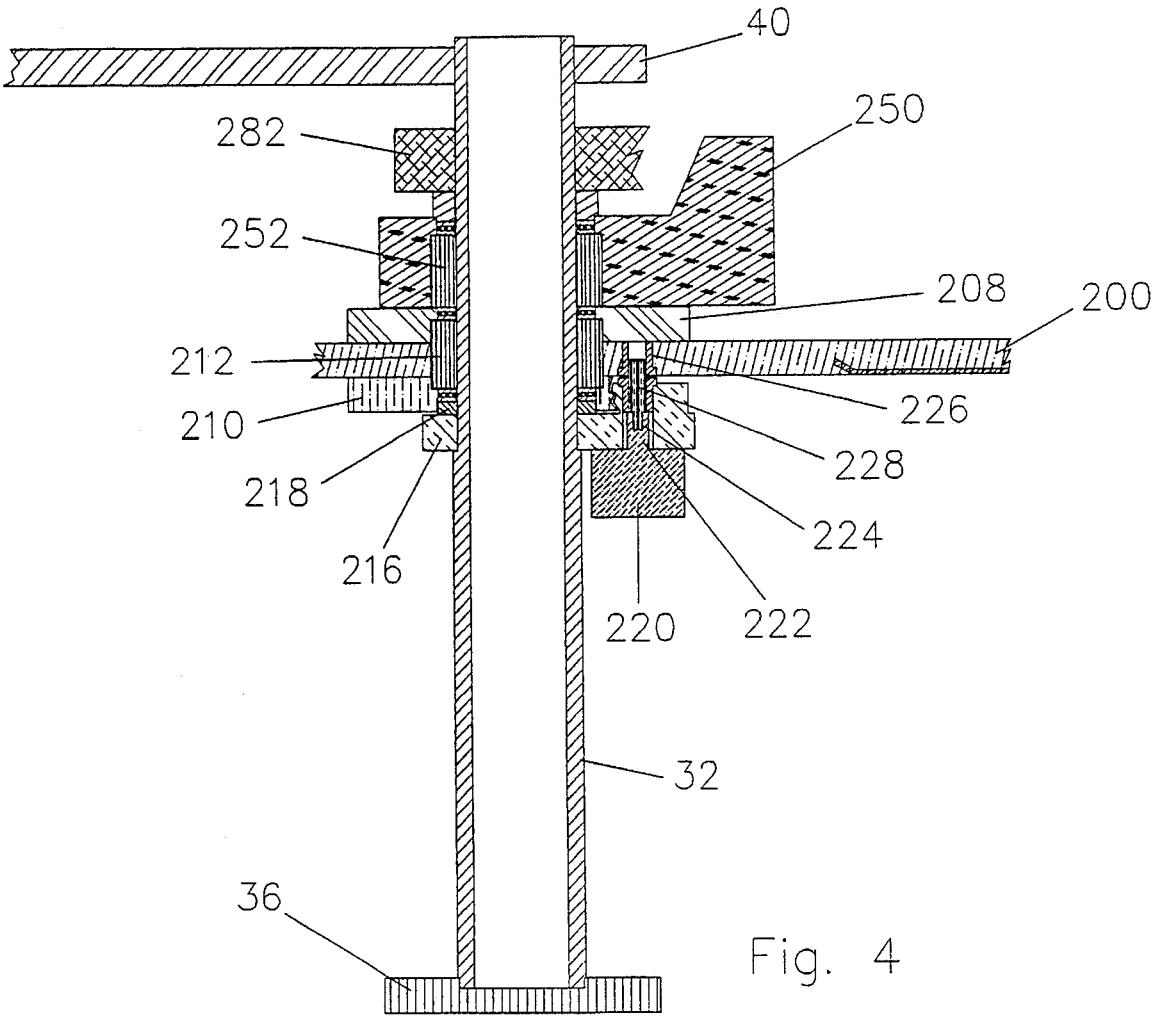
FIG. 4 is a partial cross sectional view, in vertical longitudinal section, of the main turntable support column.

As best seen in FIGS. 1–3, the automatic pocket setting sewing machine generally comprises a base 30, which supports a main turntable support column 32 at a first end of base 30 and a sewing head support column 34 at a second end of base 30. The main turntable support column 32, better seen in FIG. 4, is of elongated tubular metal construction having main turntable support column mounting ring 36 fixed at its base. The tubular construction allows wiring and pneumatic connections to be routed to the control unit. It should be noted that this description describes a pneumatic system for actuating pneumatic system. A hydraulic system could easily be substituted for the pneumatic system. The sewing head support column 34 is also of elongated tubular metal construction and has a sewing head support column mounting ring 38 fixed at its base. Mounting rings 38 and 36 may be omitted, however assembly of columns 32 and 34 perpendicular to the upper surface of base 30 is facilitated by use of the mounting rings. The longitudinal axis' of sewing head support column 34 and turntable support column 32, when mounted on base 30 must be parallel to each other. The support columns 32 and 34 must also be of sufficient rigidity to support without deflection the mechanisms that are mounted upon each respective column.

Referring back to FIGS. 1–3, a folding group support arm 40 clamped to the main turntable support column 32 supports a folding mechanism 42. The main turntable support column 32 also supports a turntable mechanism 44. The sewing head support column 34 supports an X-Y table mechanism 46 on which is mounted an industrial sewing head mechanism 48. Actuation and synchronization of the various elements and mechanisms is accomplished by pneumatic and electro-mechanical actuation under the central supervision of a microprocessor based control unit 50.

Folding Mechanism

Figure 5:
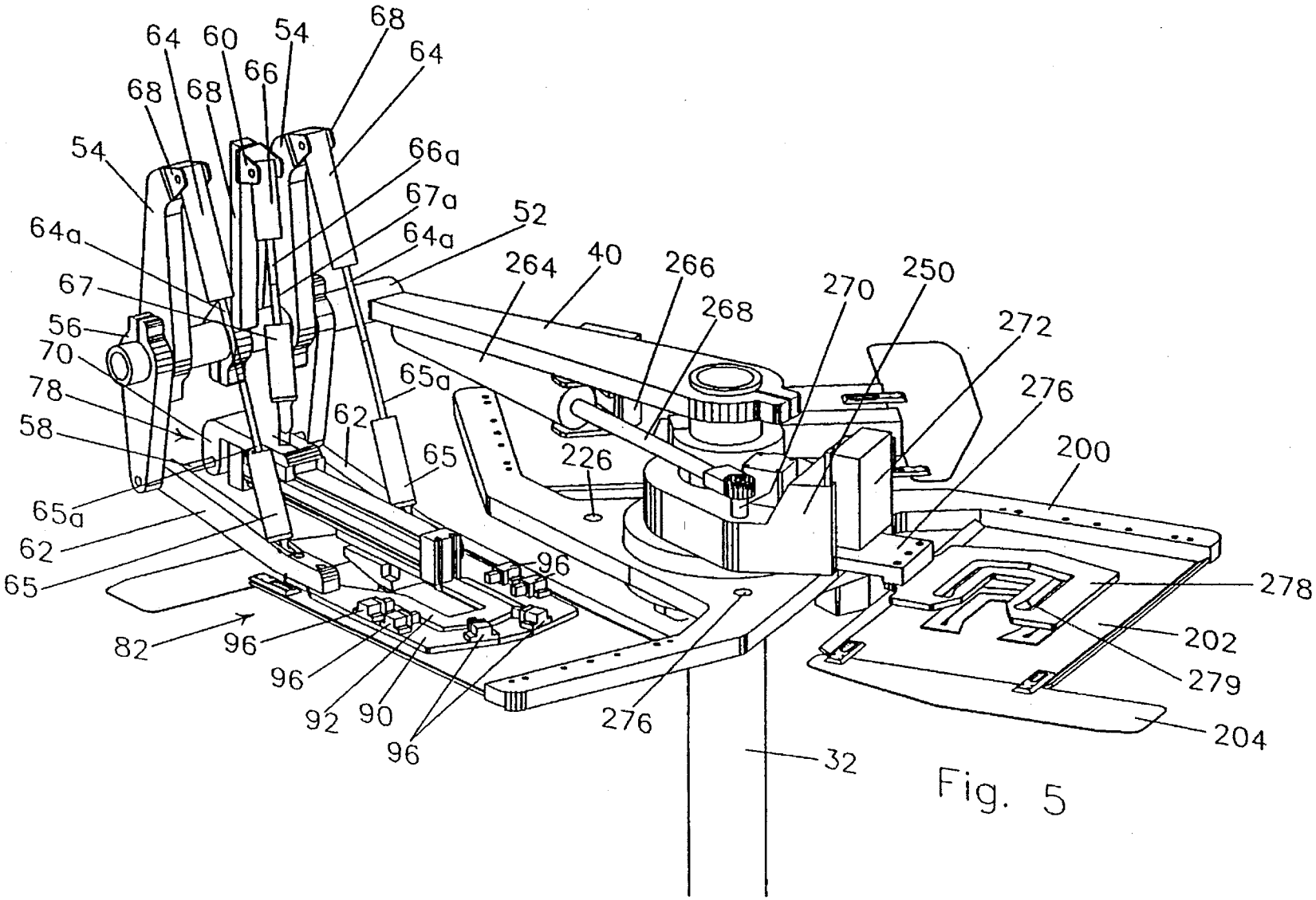
FIG. 5 is an enlarged fragmentary perspective view of the folding mechanism and turntable mechanism with the outer frame and slider in the down position.

An overall view showing the placement and orientation of the folding mechanism 42 on the folding group support arm 40 is best shown in FIG. 5. Folding group support arm 40 is an elongated bar clamped at its first end to the top of the main turntable support column 32. A tubular rod 52 is welded or otherwise permanently anchored to the second end of folding group support arm 40.

Elongated upper folding cylinder brackets 54, elongated lower folding cylinder brackets 56, and an elongated slider cylinder bracket 60 are clamped over rod 52. Each elongated bracket 54, 56, and 60 has a clamp at one end to provide rigid yet demountable attachment to rod 52. The elongated upper folding cylinder bracket 54 and elongated slider cylinder bracket 60 are vertically mounted extending upwardly away from rod 52. The clamping mechanism allows the brackets to be slightly rotated which in turn compensates for slight inequalities in the extended lengths of cylinders 64, 65, 66, and 67, however other methods of fixing the brackets to rod 52 are effective. The upper ends of upper folding cylinder bracket 54 and slider cylinder bracket 60 are fitted with pivoting connectors 68 allowing upper plate cylinders 64 and upper slider cylinder 66 to pivot in a vertical arc around connectors 68.

Referring to FIG. 5, a first end of elongated lower cylinder brackets 56 is clamped around and downwardly disposed from rod 52. The second lower ends of elongated lower cylinder brackets 56 are bored to receive pivot pin 58 inserted through the bore in each lower cylinder bracket 56. Pivot pin 58 is positioned parallel to rod 52 and serves as a fulcrum about which the remaining folding apparatus move. A first end of elongated folder support arms 62 and the slider fulcrum bracket 70 are bored and pivotally connected to pivot pin 58.

Lower plate cylinders 65 are pivotally attached at the second end of elongated folder support arms 62. Upwardly extending lower plate pistons 65*a* are connected to the downwardly extending upper plate cylinder pistons 64*a*. Connection is made at the threaded tips of each piston 64*a* and 65*a* by turnbuckle and lock nut means. Use of turnbuckle and lock nut means or other connective means that allows minor overall adjustment in combined cylinder length is preferred.

This mechanical arrangement provides for three detent positions for folding plate assembly 82 when it is vertically positioned by retraction and extension of upper plate pistons 64*a* and lower plate piston 65*a*. Folding plate assembly 82 is at its first upper position, best seen in FIG. 2, when upper plate piston 64*a* and lower plate piston 65*a* are fully retracted into upper plate cylinder 64 and lower plate cylinder 65. Folding plate assembly 82 moves to its second folding position, best seen in FIG. 6, when lower plate piston 65*a* is extended while upper plate piston 64*a* remains retracted. Folding plate assembly 82 moves to its third lowered position, best seen in FIG. 5, when both upper plate piston 64*a* and lower plate piston 65*a* are extended.

Figure 7:
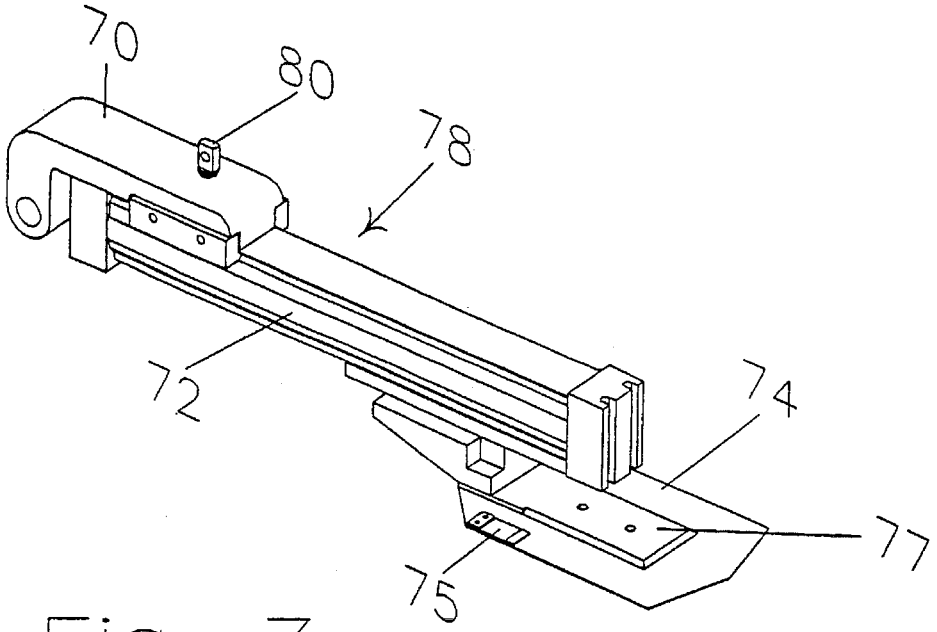
FIG. 7 is a simplified perspective view of the slider assembly.
Figure 8B:
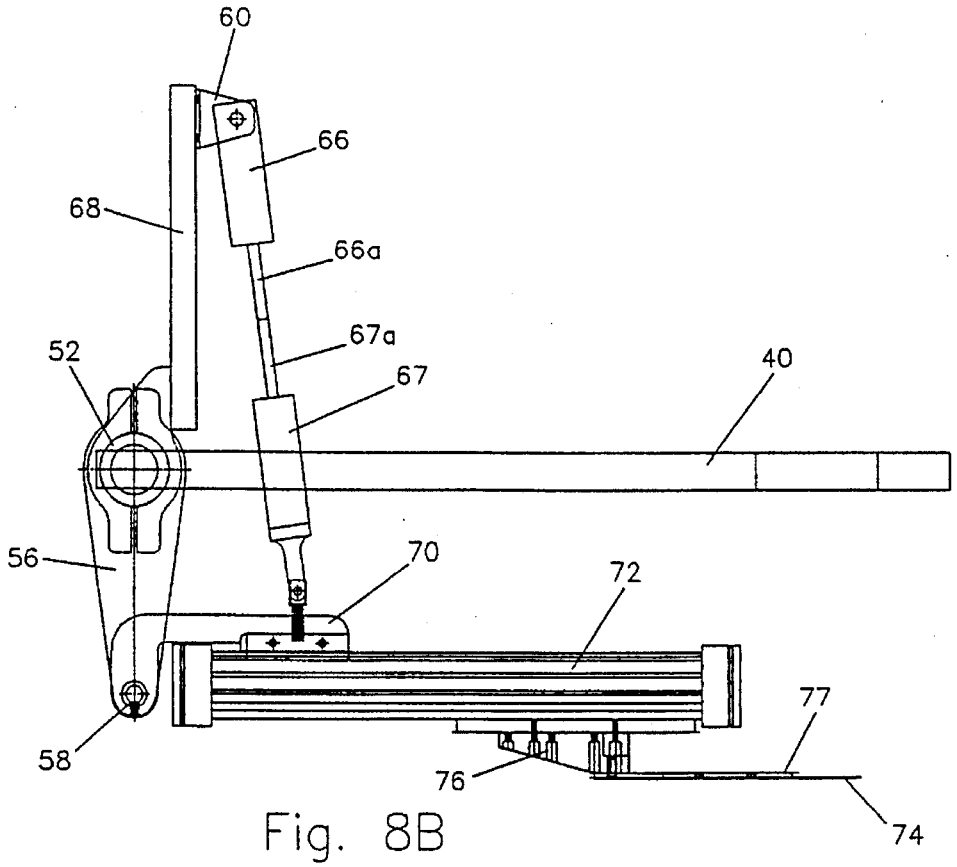
Figure 8A:
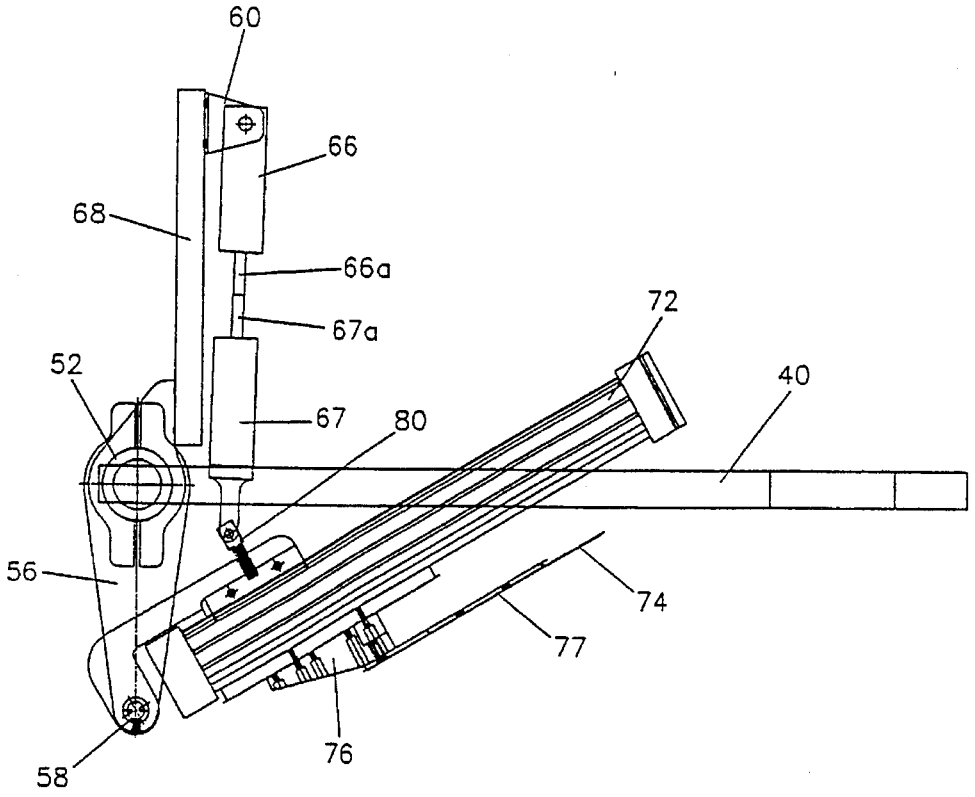

FIG. 7 depicts a slider assembly 78. An elongated double acting pneumatic slider cylinder 72 is mounted on slider fulcrum bracket 70. Slider cylinder 72 is known in the industry as a rodless type, permitting the slider attachment bracket 76 to be positioned beneath slider cylinder 72. A standard pneumatic cylinder could be used by redesigning the structure supporting the folding plate assembly 82 and the slider assembly 78. Slider 74, made of thin non rusting metal construction is positioned beneath and screwed to slider attachment plate 77 presenting a smooth flat lower surface of slider 74. Optionally attached on the upper surface of slider 74 are slider clips 75. Slider clips 75 may be advantageously used to hold some types of workpieces in position on slider 74. Slider attachment plate 77 is thicker than slider 74 thus giving more support and rigidity to the central portion of slider. The outline shape of slider 74 is shaped to correspond to the shape of the pocket that is to be sewn. Although a pocket shaped slider is herein described, other folded shapes could be provided by suitable changes in the slider outline. In operation, slider 74 can be pneumatically moved between a first retracted position, shown in FIG. 8*a*, closest to slider fulcrum bracket 70 and a second extended position most distant from slider fulcrum bracket 70 as shown in FIG. 8*b*.

Stud 80 screwed into slider fulcrum bracket 70 provides pivotal mounting position for lower slider cylinder 67, best seen in FIG. 5. Extending upwardly from lower slider cylinder 67 is lower slider piston 67*a*. Upwardly extending lower slider piston 67*a* is connected to the downwardly extending upper slider pistons 66*a*. Connection is made at the threaded tips of each piston 66*a* and 67*a* by turnbuckle and lock nut means similar to those previously described.

The vertical positioning scheme for the slider assembly is similar to that of the folding plate assembly 82. There are three vertical detent positions for slider assembly 78 when it is vertically actuated by movement of upper slider piston 66*a* and lower slider piston 67*a*. Slider assembly 78 is at its first upper position, best seen in FIGS. 1 and 8*a*, when upper slider piston 66*a* and lower slider piston 67*a* are fully retracted into upper slider cylinder 66 and lower slider cylinder 67 respectively. Slider assembly 78 moves to its second folding position, best seen in FIG. 6, when lower slider piston 67*a* is extended while upper slider piston 66*a* remains retracted. Slider assembly 78 moves to its third lowered position, best seen in FIGS. 5 and 8*b*, when both upper slider piston 66*a* and lower slider piston 67*a* are fully extended.

As best seen in FIG. 5, outer frame 90 is screwed or firmly attached by other connective means to the second end of each folder support arm 62. Design of folder support arms 62 is such that when folding plate assembly 82 is in the down position, shown in FIG. 5, outer plate 90 is resting flat on work plate 202. As best seen in FIG. 9, the inner contour of outer plate 90 is shaped to correspond to the shape of the pocket, however as can be recognized from inspection of FIG. 10*a*, the contour must be larger than the outline of the pocket by at least the width of folding blade 98. Inner frame 92 is connected and supported at its corners to outer frame 90 by adjustable height dogs 94. Adjusting shims may be placed under dogs 94 at either the outer frame 90 or inner frame 92 to move and adjust the height of inner frame 92 relative to outer frame 90. As best seen in FIG. 9, the outer contour of inner frame 92 is shaped to correspond to the shape of the pocket, however unlike outer frame 90, the contour of the inner frame 92 corresponds in size to that of the pocket to be sewn, as best seen in FIG. 10*c*. Glued to the lower side of inner frame 92, and extending around its lower periphery, is an inner plate foam pad 110 which serves to keep the second workpiece in position while it is being folded.

Figure 10A:
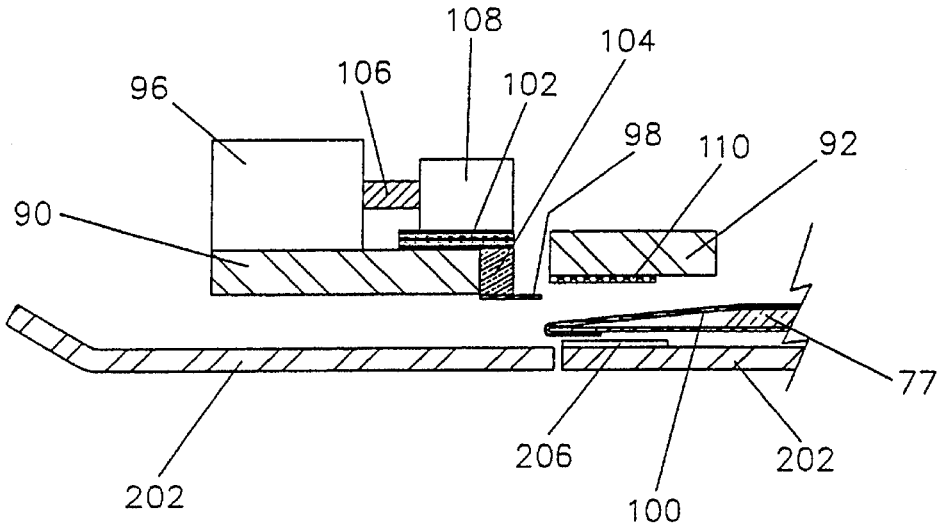
Figure 10B:
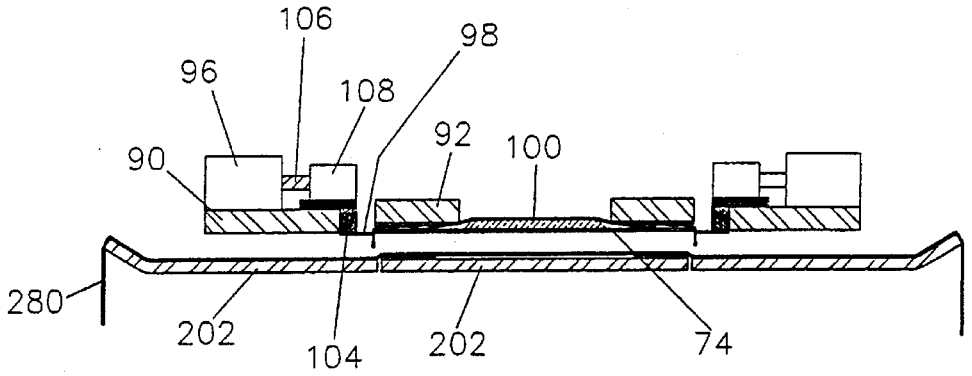
Figure 10C:
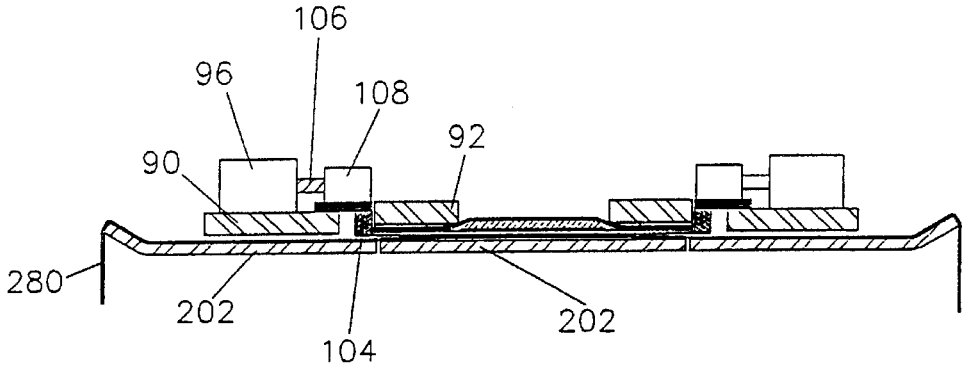

Referring to FIGS. 10*a*, 10*b*, and 10*c*, the folding mechanism comprises a folder blade 98 which is attached to a folder spacer 104. The folder spacer 104 is fixed to the side of folder plate 102. The bottom of folder clamp 108 is fixed to the top of folder plate 102. Folder clamp 108 is bored to receive folder cylinder piston 106. Folder cylinder pistons 106 are firmly anchored to folder clamp 108 with a set screw or other such means. Attached to outer frame 90 are single acting spring return pneumatic folding cylinders 96 which actuate folder cylinder pistons 106. Extension of the folder cylinder pistons 106 results in extension of folding blades 98 to a first extended folding position. Retraction of folder cylinder pistons 106 moves folding blades 98 to their second retracted position contiguous to outer frame 90.

FIG. 10*b* illustrates the folding position. Here the second workpiece 100 is resting on the slider 74. The outer frame 90 is vertically positioned at its folding position; the peripheral edges of the second workpiece 100 are hanging because the folding blades 98 have not been extended.

FIG. 10*c* illustrates the relative positions of the folding apparatus hardware when the slider assembly 78 and the folding plate assembly 82 have been moved into their third lowered position. Folding blades 98 are extended holding the folded peripheral edges of the second workpiece 100 in the folded position on the work plate 202. From this position the outer frame folding assembly 91 is moved to its first upper position, leaving slider 74 holding the folded second workpiece 202 in position.

Turntable Mechanism

Figure 6:
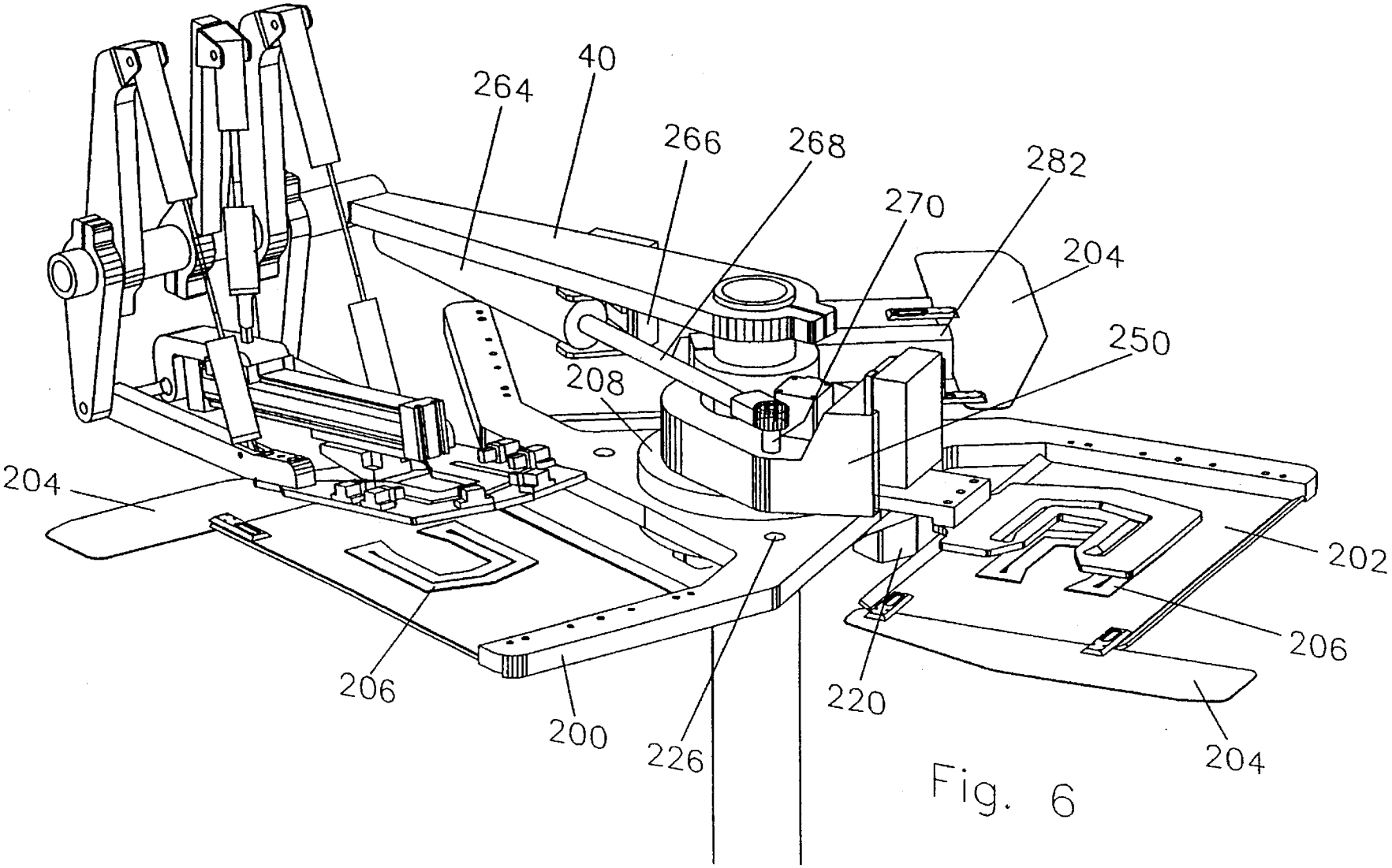
FIG. 6 is an enlarged fragmentary perspective view of the folding mechanism and turntable mechanism with the folding plate assembly in its second folding position; the slider assembly also being in its second folding position.

As depicted in FIGS. 1–6, turntable arm 200 is rotationally mounted on main turntable support column 32. Immediately above and below turntable arm 200, concentric to turntable arm 200, and fixedly attached by welding, bolting, or other means to turntable arm 200 are, respectively, upper turntable disc 208 and lower turntable disc 210. Referring to FIG. 4, upper turntable disc 208 and lower turntable disc 210 increase the effective thickness of turntable arm 200 at its center where main turntable support column 32 passes through the assembly. This feature allows a longer turntable arm rotary bearing 212 to be used, thus providing more rigid support for turntable arm rotary bearing 212. A first end of a horizontal work plate 202 is bolted or otherwise fixed to turntable arms 200 providing a work surface over which a first work piece 280 may be loaded. If it is desired to make the machine sew more than one shape of pocket, it is desirable to detachable mount work plate 202 to turntable arm 200. In the preferred embodiment the first workpiece 280 is an already finished pocketless shirt. However, the first workpiece may be any other piece of material, fabric, or plastic, to which a second workpiece is to be attached. As shown in FIG. 10*a* work plate 202 has opposing edges beveled upwardly to increase the rigidity of work plate 202 and yet keep work plate 202 light. Work plate 202 is of rigid construction but is sprung slightly upwardly when clamp 278 is in its retracted position. When clamp 278 is in its clamping position and is holding the first workpiece 280 and second workpiece 100 in place on work plate 202, work plate 202 is deflected downward into a horizontal position perpendicular to the Z axis of needle 340. As best seen in FIGS. 6, and 10*a*, a thin strip of work plate foam 206 is glued to the underside of work plate 202 to ensure that fabric workpiece 280 doesn't slip out of position once it has been placed on the work plate 202. Slot 214 is machined through work plate 202 in the outline of the seam to be sewn allowing passage of needle 340 to the lower head 322 during the sewing operation. Slot 214 is a straight sided slot. Work plate foam 206 is shaped to extend from ⅓ to ¾ of an inch on either side of slot 214 although these dimensions may be expanded or contracted to suit the dimensions of the workpieces and the size of the seam outline. Work plate foam 206 allows work plate 202 to be smooth and non-snagging and yet provides limited non-sliding friction between first work piece 280 and work plate 202 during the folding and loading operations.

Best viewed in FIG. 3, gage plate 204 is anchored to the edge of work plate 202 most distant from turntable arm 200. Gage plate 204 is shaped to approximate the neck and shoulder slope pattern of a shirt to be sewn. This feature allows a shirt to be easily positioned by placing the shoulders and neck of a shirt at a precise location. This provides more repeatable and exact positioning of a shirt allowing pockets to be more accurately placed and sewn. Of course, if first workpiece 280 is another piece of material, such as sleeve or shoulder material, gage plate 204 may be eliminated and replaced with other suitable positioning devices.

As best seen in FIGS. 2 and 4, lower locking cylinder mounting pad 216 is clamped or otherwise fixedly attached to main turntable support column 32 beneath the lower turntable disc 210 and parallel to the lower turntable disc 210. At the main turntable support column 32, the first end of lower locking cylinder mounting pad 216 provides vertical support for the lower thrust bearing assembly 218; at its second outboard end, a double acting pneumatic lower locking cylinder 220 is bolted to lower locking cylinder mounting pad 216. Lower locking cylinder 220 is mounted with lower locking piston 222 extending upwardly through a bore in lower locking cylinder mounting pad 216. In the region of lower locking cylinder 220 the thickness of lower locking cylinder mounting pad 216 is increased to provide a bore extending to close proximity to the top of the lower surface of turntable arm 200. Lower locking bushing 228 is pressed into the bore in the lower locking cylinder mounting pad 216.

A similar bore is provided in turntable arm 200 at an equal radial distance from main turntable support column 32 as is located the lower locking bushing 216. Turntable locking bushing 226 is pressed into the turntable arm bore. These bushings need not be pressed into place but must be fixed in the bore. Other methods such as holding with a set screw are acceptable. At a certain rotational position of turntable arm 200, lower locking bushing 228 and turntable locking bushing 226 come into alignment, allowing lower locking alignment pin 224, threaded onto lower locking piston 222, to be entered into both lower locking bushing 228 and turntable locking bushing 226 at the same time when lower locking piston 222 is extended in an upwardly direction. This upward extension of lower locking alignment pin 224 into both lower locking bushing 228 and turntable locking bushing 226 results in turntable arm 200 being locked in a non rotational mode. Downward retraction of lower locking alignment pin 224 allows turntable arm 200 to freely rotate. For every work plate on which sewing or another operation is to be performed, a locking position is provided. Because three work plates 202 are provided in the preferred embodiment, three detent positions of turntable arm 200 are provided by positioning three turntable locking bushings about the turntable arm 200. Of course, if a different number of detent positions of turntable arm 200 were desired, turntable arm 200 could be equipped with a suitable number of properly positioned detent positions and turntable locking bushings 226.

As best shown in FIGS. 1 and 4, clamp plate pivot block 250 is mounted on main turntable support column 32 above the upper turntable disc 208. Clamp plate pivot block 250 is sufficiently thick to permit insertion of clamp plate pivot block radial bearing 252 in a central bore making clamp plate pivot block 250 rotatable about the axis of main turntable support column 32. Double acting pneumatic upper locking cylinder 254 is bolted, screwed, or otherwise anchored by to the upper surface of the clamp plate pivot block 250, as best shown in FIGS. 3, 5, 6, and 11. Upper locking piston 256, when activated extends downwardly through a bore in clamp plate pivot block 250 into which bore is pressed clamp plate pivot block locking bushing 260. Upper locking alignment pin 258 is threaded in co-axial alignment onto upper locking piston 256.

A bore is provided in upper turntable disc 208 at an equal radial distance from main turntable support column 32 as the bore housing the clamp plate pivot block locking alignment bushing 260; into this bore is pressed upper turntable disc locking alignment bushing 262.

When upper turntable disc 208 is an indexed position, the clamp plate pivot block locking bushing 260 and upper turntable disc locking bushing 262 are in axial alignment. When in axial alignment, upper locking piston 256 may be downwardly extended allowing upper locking alignment pin 258 to be entered into both the clamp plate pivot block locking bushing 260 and upper turntable disc locking bushing 262 at the same time. Extension of upper locking alignment pin 258 into both clamp plate pivot block locking bushing 260 and upper turntable disc locking bushing 262 results in clamp plate pivot block 250 and upper turntable disc 208 being locked and forced to rotate together. Since turntable arm 200 and upper turntable disc 208 are bolted or otherwise fixed together, turntable arm 200 is forced to rotate in unison with clamp plate pivot block 250 when upper locking piston 256 is extended.

As seen in FIGS. 5 and 6, indexing cylinder bracket 266 affixed to folding group support arm 40 supports double acting pneumatic indexing cylinder 264. Indexing piston 268 of indexing cylinder 264 is rotatably connected to pivot block pin 270. Pivot block pin 270 is pressed or otherwise fixed in a bore on clamp plate pivot block 250. Viewed from above, extension of indexing piston 268 rotates clamp plate pivot block 250 in a counter clockwise direction while retraction of indexing piston 268 rotates clamp plate pivot block 250 in a clockwise direction. When upper locking piston 256 is extended, clamp plate pivot block 250 turns turntable arm 200 to which work plates 202 are attached. The machine of the preferred embodiment has three work plates and three detent positions for turntable arm 200 making it desirable for turntable arm 200 to rotate 120 degrees when indexed. To achieve 120 degree rotation, the stroke length of indexing piston 268, radial position of pivot block pin 270 must be considered relative to the placement of indexing cylinder bracket 266 on the folding group support arm 40. Angular index rotation of 180, 120, 90, 72, or 60 degrees could be achieved by suitably modifying component parts and providing turntable arm 200 with 2, 3, 4, 5, or 6 work plates and by providing a suitable number of upper turntable disc locking bushings 262 and turntable locking bushings 226.

As best seen in FIGS. 1, 5, and 6, a double acting pneumatic dual piston flat cylinder is mounted as clamp cylinder 272. Clamp cylinder 272 is bolted or otherwise anchored to a flat side of clamp plate pivot block 250 with clamp pistons 274 downwardly extending. Clamp support 276 is affixed to the lower surfaces of clamp pistons 274. Clamp 278 is screwed or otherwise detachably anchored to clamp support 276. Clamp 278 is a flat piece of metal or other suitably rigid material slotted in the sewing pattern. In the preferred embodiment where the second workpiece 100 is a pocket, the sewing pattern corresponds to the outline of the pocket. There must be sufficient clearance so that reciprocating movement of needle 340 does not cause needle 340 to contact clamp 278. However, the shape of the sewing pattern can be quite complex and is only limited in size to the travel limits of the X-Y table mechanism 46. Clamp 278 is sized to extend outwardly one to one and a half inches from the slotted pattern. The X-Y table mechanism 46 may be quite large depending primarily on the rigidity of its component parts.

As best seen in FIGS. 12*a* and 12*b*, when clamp pistons 274 are downwardly extended, clamp 278 presses a second workpiece 100 and a first workpiece 280 against work plate 202. After sewing, clamp pistons 274 retract, raising clamp 278 and allowing workpieces 100 and 280, now sewn together to be removed from work plate 202.

Clamped on main turntable support column 32 above clamp plate pivot block 250 is a shock mount 282 housing a shock absorber 284. Shock absorber 284 is positioned to contact clamp plate pivot block 250 as clamp plate pivot block 250 rotates to its limit in the counter clockwise direction. Shock absorber 284 permits faster counter clockwise rotation of the clamp plate pivot block 250 and turntable arm 200 assembly and minimizes impact damage to the turntable mechanism 44 when the folded and loaded first workpiece 280 and second workpiece 100 are rotating into position beneath the upper sewing head 324. A small orifice drilled through the rear end of indexing cylinder provides allows a second shock absorber to be mounted on the back of indexing cylinder 264. This second shock absorber, directly connected to the air inside indexing cylinder 264, provides shock absorption when clamp plate pivot-block 250, moving in a clockwise direction, is approaching the folding mechanism 42.

FIGS. 1, 2, 3, and 13 best illustrate placement, construction, and operating limits of the stacker assembly 400. FIGS. 1 and 2 show stacker table 414 but stacker table 414 is omitted from FIGS. 3 and 13 to better illustrate stacker assembly 400. Stacker table 414 is a rigid device easily made of metal, fiberglass, or other suitable materials over which finished garments may be laid. As the garments are removed from the sewing machine and draped over the stacker table 414, a first portion of a garment would be on the side of the stacker table 414 closest to the sewing machine and the second remaining portion of a garment would be draped over the side of stacker table 414 away from the sewing machine.

Stacker arm 404 is pivotally attached to stacker bracket 402 which is anchored to a location at the bottom of the front side of base 30. Stacker cylinder bracket 406, anchored to the front side of base 30 at a location vertically above that of stacker bracket 402, serves to pivotally support stacker cylinder 408. Stacker cylinder piston 410 is pivotally clamped to stacker arm 404 allowing stacker arm 404 to be moved between a first lowered position, as illustrated in FIG. 13, and a second raised position. Clamped over stacker arm 404 are double acting pneumatic stacker fingers 412, which may be pneumatically activated to a first closed pinching position; reverse pneumatic pressure opens stacker fingers 412 to a second open position.

X-Y Mechanism

Referring to FIG. 2, at a second end of base 30, sewing head support column 34 is fixed in a vertical position by its attachment to sewing head mounting ring 38 and base 30. X-Y base 300 is a rectangular plate fastened perpendicular to sewing head support column 34. A conventional X-Y carriage, well known in the industry, is affixed atop X-Y base 300 by anchoring two parallel rails 302 to the top side of X-Y base 300, placing two ball bushing style type pillow blocks of a type well known in the industry on each parallel rail 302 and affixing to the top side of said pillow blocks a conventional dual shaft rail system 304, FIG. 2, with its shafts running perpendicular to parallel rail 302. A lead screw and mating ball screw are provided to drive each axis. The individual components and systems are well known in the industry and may be found in the product line manufactured by Thompson Industries, Inc. of Port Washington, N.Y. The lead screws are driven and controlled by X Axis servomotor 310 and Y Axis servomotor 312. Servomotors 310 and 312 are conventional brushless D.C. Servomotors that allow them to be computer controlled. Bolted or otherwise fastened to the top of dual shaft rail system 302 is rectangular sewing head mounting base 320, which is a positionable travelling surface, onto which sewing head 48 is fastened.

Sewing Head Mechanism

Sewing head 48 operates in a conventional manner that is well known in the sewing industry. As better seen in FIG. 3, sewing head 48 has a lower head 322 that is offset to the rear of the machine from the centerline of upper head 324. Sewing head 48 has conventional hook and knife trimming apparatus that are common in the industry. However, offsetting lower head 322 requires rerouting the drive mechanisms for the lower head hook and knife trimming apparatus.

Sewing head 48 is driven by sewing head servomotor 314, mounted on the sewing head base 320 and connected by drive shafts, belts, and pulleys to the needle 340 in the upper head 324 and to the hook and knife trimming mechanisms in the lower head 322. Sewing head servomotor 314 is conventional brushless D. C. Servomotor that allows the speed of the motor to be computer controlled. Needle 340 is a pointed elongated cylindrical member that reciprocates in a Z axis, a direction perpendicular to the X-Y axis travel of the travelling positionable surface. Sewing head servomotor 314 drives the Z-axis movement of needle 340. It should be noted that servomotors are not the only means to drive movement on the X, Y, and Z axis. Other motive means include combinations of linear motors and other rotationally controllable motors.

Upper head 322 is pivotable on sewing head pivot 328. Sewing head pivot 328 is mounted at the top of sewing pivot block 326 which is fixed directly on sewing head base 320. Sewing head base bracket 332 is attached to sewing head base 320 and sewing head bracket 336 is anchored at the rear of upper head 324. Pivotally connected to sewing head base bracket 332 is a double acting pneumatic sewing head cylinder 336. Sewing head cylinder piston 338 is pivotally connected to sewing head bracket 334. Extension of sewing head cylinder piston 338 positions upper head 324 in its first or down position. This is the position in which sewing is accomplished. Retraction of sewing head cylinder piston 338 raises upper head 324 to its second upper position. Upper head 322 is in the second upper position when work plate 202 is being rotated under upper head 322 and when the sewn workpieces are being removed from the machine.

Electro-Pneumatic Control

Horizontal position and speed of sewing head 48 are controlled by movement of X axis servomotor 310 and Y axis servomotor 312. Appropriate computer control allows needle 340 to traverse the stitch pattern on the garment by traversing the X-Y path of the sewing seam. Stitch density is controlled by varying the slewing speed of X-Y axis moment and the rate at which needle 340 is reciprocating in the Z axis.

All pneumatic cylinders are extended and retracted by suitable solenoid operated pneumatic valves well known in the industry. The solenoids are individually controlled by the I/O interface of the microcomputer controller. Cylinders on the sewing machine are equipped with reed switches that provide feedback to the microcomputer controller as to the position of the piston, ie. whether the piston is extended or retracted. The reed switch feedback provides information to the computer about the status of each pneumatic cylinder in turn allowing the computer to monitor and control the machine operation. These types of mechanisms and features are well known and are available as standard components from sources in the pneumatics industry.

Individual mechanical and pneumatic functions of the sewing machine are computer controlled, as seen in FIG. 14, by means well known in the computer control industry. This type of control system is well known in the electrical control industry and requires only standard components. A suitable control system is the DMC-1000 Series motion controller manufactured by Galil Motion Control, Inc. of Sunnyvale, Calif. This control system is capable of controlling the X, Y, and Z axis servomotors as well as the numerous inputs and outputs of the reed switches that detect the piston position and the solenoids powering the numerous pistons

Operation

Operation of the sewing machine is described by assuming that the machine has just completed sewing and stacking operations and that positionable elements or assemblies are at their following respective positions: upper sewing head 324 is in its first up position; stacker arm 404 is in its first lowered position, stacker fingers 412 are in their second open position; clamp 278 is in its first raised position; indexing cylinder 264 is in its second extended sewing position; lower locking lignment pin 224 is in its first extended locked position; upper locking alignment pin 258 is its first extended locked position; folding plate assembly 82 is in its first upper position; folding blades 98 are in their second retracted position; slider assembly 78 is in its first upper position; and slider 74 is at its first extended position.

A machine operator first places a first workpiece 280, in this case, a pocketless shirt, over gage plate 204 and work plate 202. A shirt may be seen positioned on the gage plate 204 and work plate 202 on FIG. 13, however this shirt is at the sewing station and not in the loading position. The appropriate gage plate 204 and work plate 204 on which the first workpiece is loaded is under folding mechanism 42. This first workpiece 280 is pulled over and around the work plate 202 so that the front of the first workpiece 280, a shirt front, lies on the upper surface of workplate 202. The waist area of the shirt is bunched around work plate 202 in the vicinity of turntable arm 202.

Slider assembly 78 is moved to its second folding position, thus preparing the slider 74 for loading of the second workpiece 100. The second workpiece 100 is laid on top of slider 74 and the slider attachment plate 77. In the preferred embodiment, the second workpiece is a pocket blank that has fabric material extending one quarter to one half of an inch beyond the sides of the slider 74. The pocket blank may have its top seam already sewn. A pocket would be positioned with the pocket top closest to the slider attachment bracket. A pocket would have its finished side facing up after it was loaded. The pocket may be held in place with slider clips if necessary.

The machine is now activated, lowering folding plate assembly 82 from its first upper position to its second folding position pressing lightly against slider 74. This position is best seen in FIG. 6. Folder blades 98 are now actuated to their first extended folding position, folding the peripheral edges of the second workpiece 100 around the sides of slider 74. After folding, and while folder blades 98 are extended, upper plate pistons **64*a* and upper slider piston 66*a* are extended together lowering both slider assembly 78 and folding plate assembly 82 together to a position on work plate 202. Slider assembly 78 is now in its third lowered position and folding plate assembly is in its third lowered position. This position is best seen in FIG. 5. Folding blades 98 are now moved to their second retracted position allowing folding plate assembly 82 to be raised to its first upper position. At this point in the machine operation, the second workpiece 100 is held against work plate 202 by the downward pressure of slider 74 against the folded edges of the second workpiece 100**.

Lower locking piston 222 is extended locking turntable arm 200. Upper locking piston 256 is retracted allowing clamp plate pivot block 250 to rotate independently of turntable arm 200. Indexing piston 264 is retracted, moving clamp plate pivot block 250 and the attached clamp cylinder 272 and clamp 278 to a position over slider 74. Upper locking piston 256 is extended into corresponding turntable locking bushing 262 causing clamp plate pivot block 250 and turntable arm 200 to be locked together. Meanwhile lower locking alignment pin 224 is still extended causing turntable arm 200 to be locked in a non-rotational mode.

Clamp pistons 274 are now extended causing clamp 278 to move from its first raised position to its second clamping position. Clamp 278 is now holding the second workpiece 100 against the first workpiece 280. Slider 74 is still in its second extended position, between the first workpiece 280 and second workpiece 100 and under clamp 278. Now, pressure is released in upper slider cylinder 66 and slider 74 is moved to its first retracted position. Slider assembly 78 is now moved to its first upper position. Folded first workpiece 280 and second workpiece 100 are now clamped to work plate 202 by downward pressure of the clamp pistons 274.

Lower locking piston is now retracted moving lower locking alignment pin 224 to its second retracted rotational position. Since upper locking alignment pin 258 is extended, locking clamp plate pivot block 250 and turntable arm 200 together, extension of indexing piston 268 at this time, results in turntable arm 200, rotating counter clockwise, moving the clamped together workpieces beneath the upper sewing head 324. Action of clamp plate pivot block 250 against first shock absorber 284 correctly positions clamp plate pivot block 250 and reduces shock to the surrounding structure. Lower locking piston now extends causing lower locking alignment pin 224 to move to its first extended locked position and locking turntable arm 200 in a non rotational mode.

A new work plate 202 is now at the folding mechanism ready to be loaded with a new first workpiece 280 as previously described. The loading and folding operation can take place on the new first workpiece 280 while the machine sews the original first workpiece 280 and second workpiece 100 as will now be described.

Sewing head piston 338 is extended moving upper sewing head 324 to its down sewing position. Sewing is done under computer program control of sewing head servomotor 314, X axis servomotor 310 and Y axis servomotor 312, resulting in needle 340, sewing the first workpiece 280 and second workpiece 100 together, tracing the proper stitch outline around bevelled clamp slot 279 and stitching with the proper stitch density.

After sewing is completed, sewing head piston 338 is retracted raising upper sewing head 324 to its first up position. Now clamp piston 274 is retracted moving clamp 278 to its first raised position.

With sewing complete and the work pieces ready to be removed from the sewing station, stacker arm 404 is moved to its second raised position by retraction of stacker cylinder piston 410 with stacker fingers 412 in their second open position. With stacker arm 404 at its second raised position, stacker fingers 412 surround the workpieces or garment that has just been sewn. Stacker fingers 412 now close to their first pinching position and grasp the garment. With stacker fingers 412 in their first pinching position, stacker cylinder piston 410 is extended, thus lowering stacker arm 404 and pulling the garment off work plate 202 to a position draped over stacker table 414. With stacker cylinder piston 410 partially extended and stacker arm 404 part way to its first lowered position and the garment draped over stacker table 414, stacker fingers 412 are moved to their second open position thus releasing the garment. With stacker fingers 412 now in their second open position, stacker cylinder piston 410 continues to extend and finally moves stacker arm 404 to its first lowered position.

The previously described versions of the invention have many advantages, including the ability to sew a pocket on a previously completed shirt. Changing pocket shapes, garment, and seam patterns are easily accommodated by software changes and minor changes to a few component parts. Bunching of workpiece materials caused by sliding workpieces over flat tables is eliminated because workpiece materials, once clamped, are not moved by sliding. Because this sewing machine allows an operator to load subsequent workpieces while previous workpieces are being sewn, and the machine accomplishes loading and folding at one work station, where the folding mechanism 82 is located, machine cycle time is fast. Moreover, the simple construction with a minimum number of moving parts results in a low cost machine that is easily maintained.

Although the invention has been described in considerable detail with reference to the preferred embodiment and other illustrative embodiments, the claims are not limited to these embodiments, but rather are directed to all modifications and variations that are within the spirit and scope of this invention and that may be conceived and reduced to practice by those skilled in the art.

What is claimed is:

1. An automatic sewing machine comprising:

(a) a base having a loading station and a sewing station;

(b) a turntable support column having a column axis and a column radius extending outwardly from said column axis, said turntable support column mounted on said base;

(c) a turntable arm rotationally mounted on said turntable support column so as to rotate about said column axis between said loading station and said sewing station;

(d) a work plate having a first end and a second end, said first end fixedly attached to said turntable arm, said second end disposed outwardly from said turntable arm and upwardly from said first end;

(e) a clamp rotationally mounted on said turntable support column and having a stroke release position and a stroke clamp position contiguous to said work plate, so that when said clamp is in the clamp position said clamp exerts downward pressure on said work plate and deflects said work plate to a horizontal position.

(f) a moveable sewing head attached to said base at said sewing station.

2. The automatic sewing machine of claim 1 in which said work plate and said clamp rotate between said loading station and said sewing station when said clamp is exerting downward pressure on said work plate and deflecting said work plate to said horizontal position.

3. The automatic sewing machine of claim 1 further having (a) a pivot block rotationally mounted on said turntable support column;

(b) a support arm fixedly attached to said turntable support column; and (c) an indexing cylinder having a first end pivotally attached to said support arm and a second end pivotally mounted to said pivot block.

4. The automatic sewing machine of claim 3 further comprising:

(a) a locking cylinder fixed to said pivot block, said locking cylinder having a piston, said piston having a first locking position and a second release position; and (b) a turntable disc, said turntable disc contiguous to said pivot block and fixedly attached to said turntable support column and having a bore disposed parallel to said turntable support column so that when said piston is in said first locking position said piston is disposed within said bore causing said pivot block to be positionally locked.

5. The automatic sewing machine of claim 4 further comprising:

(a) an orifice disposed within said turntable arm parallel to said turntable support column;

(b) a lower locking cylinder fixedly attached to said turntable support column, said lower locking cylinder having a lower locking piston having a first locking position and a second release position, so that when said lower locking piston is said first locking position, said piston is disposed within said orifice of said turntable arm causing positional locking of said turntable arm.

6. The automatic sewing machine of claim 1 further comprising means for loading a first workpiece and a second workpiece onto said work plate while said work plate remains at said loading station.

7. The automatic sewing machine of claim 6 in which said first workpiece and said second workpiece are held between said work plate and said clamp when said clamp is exerting downward pressure on said work plate and deflecting said work plate to a horizontal position.

8. The automatic sewing machine of claim 7 in which said work plate and said clamp rotate between said loading station and said sewing station when said clamp is exerting downward pressure on said work plate and deflecting said work plate to said horizontal position.

9. The automatic sewing machine of claim 8 further comprising:

(a) a stacker arm pivotally attached to said base so that said stacker arm moves between a first position contiguous to said work plate when said work plate is at said sewing station and a second position; and (b) a stacker finger, fixedly attached to said stacker arm, said stacker finger having an open position and a closed position, so that said stacker finger may close on said workpieces when said stacker arm is at said first position.

10. A sewing machine comprising:

(a) a base having a loading station and a sewing station;

(b) a support column having a column axis and a column radius extending outwardly from said column axis, said support column mounted on said base;

(c) a turntable arm rotationally mounted on said support column so as to rotate about said column axis between said loading station and said sewing station;

(d) a pivot block rotationally mounted on said support column;

(e) a support arm fixedly attached to said support column;

(f) an indexing cylinder having a first end pivotally attached to said support arm and a second end pivotally attached to said pivot block; and (g) means to detachably engage said pivot block to said turntable arm.

11. The sewing machine of claim 10 where the means to detachably engage said pivot block comprises a locking cylinder having a piston, said piston having a first locking position and a second release position so that when said locking piston is in said locking position said turntable arm is pivotally engaged to said turntable arm.

12. The sewing machine of claim 11 further comprising:

(a) an orifice disposed within said turntable arm, said orifice being parallel to said column axis;

(b) a lower locking cylinder fixedly attached to said support column, said lower locking cylinder having a locking piston having a first locking position and a second release position, so that when said locking piston is said first locking position, said locking piston is disposed within said orifice of said turntable arm causing positional locking of said turntable arm.

13. The sewing machine of claim 12 additionally comprising a clamp fixedly attached to said pivot block.

14. The sewing machine of claim 10 further comprising a work plate having a first end and a second end, said first end fixedly attached to said turntable arm, said second end disposed outwardly from said turntable arm and upwardly from said first end.

15. A method for sewing a workpiece comprising:

(a) positioning a workpiece on a work plate mounted on a turntable arm while said work plate is at a loading station;

(b) disengaging a clamp from the turntable arm so that the clamp can rotate independently from the turntable arm;

(c) rotating the disengaged clamp to the loading station;

(d) clamping the positioned workpiece to the work plate while the work plate remains at the loading station;

(e) engaging the rotated disengaged clamp to said turntable arm so that the clamp rotates with the turntable arm;

(f) indexing the engaged clamp, positioned workpiece, work plate and turntable arm to a sewing station;

(g) locking the indexed clamp, workpiece, work plate and turntable arm at the sewing station;

(h) sewing the locked workpiece; and (i) unlocking the locked turntable arm and work plate.

16. The method of claim 15 further comprising deflecting the work plate to a horizontal position as the positioned workpiece is clamped to the work plate.

17. The method of claim 16 further comprising the steps (a) positioning a stacker arm to a location contiguous to the sewn workpiece while the sewn workpiece and work plate are at the sewing station;

(b) grasping the sewn work piece while the sewn work piece and work plate are at the sewing station;

(c) withdrawing the sewn work piece from the work plate while the work plate is at the sewing station.

18. The method of claim 15 additionally comprising:

(a) loading an additional work piece on a slider;

(b) folding the loaded additional work piece around the slider;

(c) moving the folded additional work piece and the slider to a position contiguous with the work piece positioned on the work plate;

(d) clamping the folded additional work piece and positioned work piece to the work plate; and (e) withdrawing the slider from between the clamped folded additional work piece and positioned work piece.

* * * * *